US006338384B1

(12) United States Patent
Sakaue et al.

(10) Patent No.: US 6,338,384 B1
(45) Date of Patent: Jan. 15, 2002

(54) DOWNFLOW LIQUID FILM TYPE CONDENSATION EVAPORATOR

(75) Inventors: Seiichi Sakaue; Hideyuki Hashimoto, both of Tokyo; Junichi Ohya, Hyogo, all of (JP)

(73) Assignee: Nippon Sanso Corporation, Hyogo (JP)

( * ) Notice: Subject to any disclaimer, the term of this patent is extended or adjusted under 35 U.S.C. 154(b) by 0 days.

(21) Appl. No.: 09/555,898

(22) PCT Filed: Oct. 4, 1999

(86) PCT No.: PCT/JP99/05440

§ 371 Date: Jun. 5, 2000

§ 102(e) Date: Jun. 5, 2000

(87) PCT Pub. No.: WO00/20812

PCT Pub. Date: Apr. 13, 2000

(30) Foreign Application Priority Data

Oct. 5, 1998 (JP) ..... 10-283065

(51) Int. Cl.[7] ..... F28F 3/00
(52) U.S. Cl. ..... 165/166; 62/903
(58) Field of Search ..... 165/166, 115; 62/903

(56) References Cited

U.S. PATENT DOCUMENTS 2,595,308 A * 5/1952 Simpelaar ..... 165/166 X
3,256,704 A * 6/1966 Becker ..... 165/166
3,282,334 A * 11/1966 Stahlheber ..... 165/166
3,860,065 A * 1/1975 Schauls ..... 165/166
4,599,097 A * 7/1986 Petit et al. ..... 165/166
5,122,174 A 6/1992 Sunder et al. ..... 62/903 X
5,438,836 A 8/1995 Srinivasan et al. ..... 62/903 X
5,730,209 A * 3/1998 Sunder et al. ..... 165/166 X

FOREIGN PATENT DOCUMENTS

JP 63-143486 6/1988
JP 6-14772 2/1994

* cited by examiner

*Primary Examiner*—Leonard Leo
(74) *Attorney, Agent, or Firm*—Armstrong, Westerman, Hattori, McLeland and Naughton, LLP

(57) ABSTRACT

A downflow reboiler-condenser which can distribute and introduce an evaporating fluid (fluid to be evaporated) uniformly and securely into evaporation passages and which can also achieve simplification of its structure and reduction in the fabrication cost. This reboiler-condenser is provided with a reservoir 36 above a heat exchanger core 34 and with liquid distributors 37 located above evaporation passages 33 respectively. The liquid distributors 37 distribute the evaporating fluid collected in the reservoir 36 into the evaporation passages 33 uniformly.

6 Claims, 7 Drawing Sheets

DOWNFLOW LIQUID FILM TYPE CONDENSATION EVAPORATOR

TECHNICAL FIELD

The present invention relates to a downflow reboiler-condenser. More specifically the present invention relates to a downflow reboiler-condenser having liquid distributing means for distributing and introducing a fluid to be evaporated (a vaporizing fluid) uniformly to evaporation passages of a plate fin type heat exchanger core having condensation passages and the evaporation passages juxtaposed alternately via parting sheets, and particularly to a plate fin type downflow reboiler-condenser suitably used in a double distillation column of an air separation plant.

BACKGROUND ART

According to air separation using a double distillation column, liquid oxygen present at the bottom of a low-pressure distillation column (hereinafter referred to as low pressure column) or in a vessel communicating with the low pressure column is subjected to indirect heat exchange with an overhead nitrogen gas of a high pressure distillation column (hereinafter referred to as high pressure column) in a heat exchanger located at a middle part of the double distillation column to effect vaporization of a part of the liquid oxygen to form an ascending agas in the low pressure column and also condensation of the nitrogen gas into a liquid to form a reflux in these two distillation columns. Such heat exchanger is generally referred to as a reboiler-condenser.

As the reboiler-condenser, those using plate fin type heat exchanger cores are generally used. The plate fin type heat exchanger core has a multiplicity of heat exchange passages composed essentially of condensation passages and evaporation passages arranged adjacent to one another via parting sheets, and a fluid to be condensed or condensing fluid (i.e., nitrogen gas) which is introduced in the form of gas and a fluid to be evaporated or evaporating fluid (i.e., liquid oxygen) which is introduced in the form of liquid are subjected to indirect heat exchange with each other to effect condensation of the former fluid into a liquid which is withdrawn to a lower part of the heat exchanger and also to effect vaporization or gasification of a part of the latter fluid into a gas which is withdrawn to a lower part or to a lower part and an upper part of the heat exchanger.

FIG. 1 shows a reboiler-condenser using a submerged plate fin type heat exchanger core (i.e. a submerged reboiler-condenser) utilizing the thermosyphon effect. This reboiler-condenser 1 is used as submerged in an evaporating fluid (liquid oxygen LO) collecting in a reservoir 2*a* located at the bottom of a low pressure column 2. In the reboiler-condenser 1, the inlet ends and outlet ends (the upper ends and the lower ends) of heat exchange passages (evaporation passages) for the evaporating fluid (liquid oxygen LO) are open, and an overhead nitrogen gas GN in a high pressure column 3 is introduced via an upper header 1*a* into the condensation passages. The liquid nitrogen formed by the condensation in the condensation passage is withdrawn from a lower header 1*b*.

The liquid oxygen in the evaporation passages is subjected to indirect heat exchange with the condensing fluid (nitrogen gas GN) in the adjacent condensation passages to be vaporized partly to form oxygen bubbles which ascend along the evaporation passages. The ascending force of this oxygen gas and the difference in the density of the vapor and that of the liquid in the vapor-liquid mixture bring about the thermosyphon effect and form a circulatory flow in the liquid oxygen LO inside and outside the reboiler-condenser 1. Of the oxygen assuming the form of vapor-liquid mixture withdrawn as an ascending stream, the liquid oxygen which did not vaporize returns to the reservoir 2*a*, whereas the oxygen gas forms an ascending gas in the low pressure column 2, and a part of the gas is withdrawn as a product through a line 4.

Meanwhile, the nitrogen gas GN introduced into the condensation passages is condensed into liquid nitrogen by the indirect heat exchange with the liquid oxygen and is withdrawn from the bottom of the reboiler-condenser 1. While the thus withdrawn liquid nitrogen is introduced as a reflux to the above two columns, it is occasionally withdrawn partly as a liquid product.

The submerged reboiler-condenser 1 utilizing the thermosyphon effect, as described above, is a counterflow type heat exchanger where the condensing fluid and the evaporating fluid form a downward flow and an upward flow respectively. Since the reboiler-condenser 1, as used, is submerged entirely in liquid oxygen, the liquid head of the liquid oxygen isubcools the liquid oxygen flowing from the bottom of the reboiler-condenser 1 to the evaporation passages.

Accordingly, some distance is necessary for the liquid oxygen until it starts boiling or until the temperature of the liquid oxygen is heated by the indirect heat exchange with the condensing nitrogen gas to reach the saturated temperature. This distance occasionally amounts to 20 to 30% of the height of the heat exchanger. That is, the submerged reboiler-condenser 1 has not enough heat transfer surface area to use the heat transfer surface area over the entire height of the heat exchanger.

Further, the liquid head of the liquid oxygen as an evaporating fluid causes a rise in the boiling point of the liquid oxygen as the evaporating fluid, and the temperature difference $\Delta T$ between oxygen and nitrogen is reduced (temperature pinch) as shown in FIG. 2, to lower the quantity of heat to be exchanged on the designed heat transfer surface area. Therefore, it is now necessary to maintain the temperature difference $\Delta T$ at a fixed level in order to maintain the heat load. As a technique for achieving this, the pressure of the condensing nitrogen gas or the operating pressure of the high pressure column is generally increased in such an amount as to cope with the elevation of the boiling point of the liquid oxygen, leading to an increase in power consumption.

In addition, a large amount of liquid oxygen must be stored to allow the reboiler-condenser 1 to function duly, and it takes a long time to start up the system, or a large amount of liquid oxygen is discharged when the reboiler-condenser 1 is stopped, causing waste of power and personnel cost.

In order to eliminate such inconvenience in the submerged reboiler-condenser utilizing the thermosyphon effect as described above, there is proposed a reboiler-condenser utilizing a concurrent heat exchanger, in which an evaporating fluid is vaporized as it flows down from the top of each evaporation passage in the heat exchanger. This type of reboiler-condenser is generally referred to as a downflow reboiler-condenser.

FIG. 3 shows a downflow reboiler-condenser 5 using a plate fin type heat exchanger. A liquid oxygen LO flowing down from a distillation section 2*b* of a low pressure column 2 further flows down from the top of the reboiler-condenser 5 together with the liquid oxygen supplied by a pump 6 from a reservoir 2*a* located at the bottom of the low pressure column and is subjected to indirect heat exchange with a nitrogen gas flowing concurrently in adjacent condensation passages to be vaporized partly. The thus obtained oxygen gas is withdrawn from the bottoms of the evaporation passages into the low pressure column 2, while the liquid oxygen which did not vaporize is withdrawn from the bottoms of evaporation passages to collect in the reservoir 2*a* located at the bottom of the low pressure column. The thus collected liquid oxygen is returned to the top of the reboiler-condenser 5 for circulation by the pump 6. Since the nitrogen side is of the same configuration as described above, the same and like elements are affixed with the same reference numbers respectively, and detailed description of them will be omitted.

As described above, since the downflow reboiler-condenser 5 forms no liquid head in the liquid oxygen to be evaporated, the heat exchanger comes to have substantially uniform temperature difference $\Delta T$ over the entire height thereof, causing evaporation of the liquid oxygen to take place throughout the heat exchanger. This achieves improvement of heat exchange effectiveness, downsizing and cost reduction in the heat exchanger, as well as, reduction of power consumption, starting time, etc.

Referring to the above downflow reboiler-condenser, those of various structures or constitutions have so far been proposed, for example, in Japanese Patent Publication Nos. Hei 5-31042 and Hei 7-31015 and Japanese Unexamined Patent Publication No. Hei 8-61868. In these reboiler-condensers described in the above official gazettes, there are proposed liquid distributing means for carrying out stepwise liquid distribution as liquid distributing structures for supplying liquid fluids to be evaporated uniformly to evaporation passages.

For example, in the reboiler-condenser disclosed in Japanese Patent Publication No. Hei 5-31042, the liquid distributing means for carrying out stepwise liquid distribution is composed of a pre-distribution section and a fine distribution section; the former is formed of orifices, and the latter utilizes distributing actions of hardway finning (serrated finning). Meanwhile, in Japanese Patent Publication No. Hei 7-31015, the liquid distributing means is composed of a pre-distribution section and a fine distribution section; the former employs pipe orifices and the latter utilizes distributing actions of hardway finning (serrated finning). Further, in Japanese Unexamined Patent Publication No. Hei 8-61868, the area fraction of the perforated finning used as the hardway finning is changed stepwise. each of these liquid distributing means disclosed in these official gazettes is integrated into a heat exchanger core by brazing to constitute a reboiler-condenser.

The liquid distributing means housed in an upper part of a plate fin type heat exchanger in the conventional downflow reboiler-condenser, as described above, involves a problem that fabrication of the heat exchanger costs are high, since it is composed of a pre-distribution section and a find distribution section, and that it has an intricate structure where an evaporating fluid assuming the liquid form to be withdrawn from the fine distribution section is allowed to flow down evaporation passages formed adjacent to each condensation passage via guide plates, such as side bars located at the tops of condensation passages.

DISCLOSURE OF THE INVENTION

It is an objective of the present invention to provide a downflow reboiler-condenser having a liquid distributor at the tops of evaporation passages in a heat exchanger core enabling distribution and introduction of an evaporating fluid uniformly and securely into the evaporation passages and also achieving simplification of the structure and reduction in the fabrication cost.

The downflow reboiler-condenser contains a plate fin type heat exchanger core in which a plurality of condensation passages and a plurality of evaporation passages are formed alternately and successively in spaces defined by a plurality of parallel and vertical parting sheets, respectively, and the reboiler-condenser carries out indirect heat exchange via the parting sheets between a gaseous fluid to be condensed (condensing fluid) introduced from an upper lateral side of the condensation passages and a fluid to be evaporated (evaporating fluid) flowing down onto each evaporation passage to effect condensation of the condensing fluid into a liquid and also vaporization of the evaporating fluid into a gas.

In the downflow reboiler-condenser according to one aspect of the present invention, the evaporation passages are each formed to have an upper end opening and a lower end opening; a reservoir communicating with the upper end opening of each evaporation passage is located above the heat exchanger core; and a liquid distributor is located above each evaporation passage to distribute the evaporating fluid collected in the reservoir into the evaporation passages. Otherwise, the reservoir is defined by the upper end openings and the lower end openings of the evaporation passages being provided, with one header having a pipe for introducing the evaporating fluid and another header having a pipe for withdrawing the evaporating fluid, respectively.

According to a second aspect of the present invention, the evaporation passages are each formed to have an upper lateral opening and a lower end opening; a liquid receiver is located around the upper lateral openings; and a liquid distributor is located above each evaporation passage, the liquid distributor distributing the evaporating fluid to be introduced from the liquid receiver into the evaporation passages through the upper lateral openings respectively. Otherwise, the upper lateral openings and the lower end openings of the evaporation passages are provided with a header having a passage for introducing the evaporating fluid in place of the liquid receiver and with another header having a pipe for withdrawing the evaporating fluid, respectively.

According to a third aspect of the present invention, the evaporation passages are each formed to have an upper lateral opening and a lower lateral opening; a header having a pipe for introducing the evaporating fluid is located around the upper lateral openings; another header having a pipe for withdrawing the evaporating fluid is located around the lower lateral openings; and a liquid distributor is located above the evaporation passages to distribute the evaporating fluid to be introduced into the evaporation passages through the upper lateral openings.

Further, the downflow reboiler-condenser is characterized in that each liquid distributor is of a hardway finning, or that the liquid distributor is composed essentially of a hardway finning serving as an upper liquid distributing section and an easyway finning serving as a lower liquid leading section, or that each liquid distributor is composed essentially of an easyway finning serving as an upper liquid inlet section, a hardway finning serving as an intermediate liquid distributing section and an easyway finning serving as a lower liquid leading section or that each liquid distributor is composed essentially of a hardway finning serving as an upper liquid inlet section, a hardway finning serving as an intermediate liquid distributing section and an easyway finning serving as a lower liquid leading section.

The downflow reboiler-condenser is also characterized in that the hardway finning is of a serrated finning or that the easyway finning of the liquid leading section has a fin pitch not longer than the length of the serration of the hardway finning in the liquid distributing section.

It should be noted here that one kind of finning preferably constitutes integrally the hardway finning serving as the upper liquid inlet section and that serving as the intermediate liquid distributing section. The serration length of the hardway finning is preferably not longer than the fin pitch of the finning located in each evaporation passage. The easyway finning in each liquid leading section is preferably of a serrated finning. The easyway finning in the liquid leading section may have a fin pitch equal to, or ½, the pitch of the finning located in each evaporation passage. The upper end portions of the condensation passages present adjacent to the liquid distributors, as well as, the condensation passages lower than the condensing fluid withdrawing header in the case where the evaporating fluid withdrawing header is located at a lower lateral side of the heat exchanger core are preferably defined as dummy passages where no fluid flows.

As has been described above, according to the downflow reboiler-condenser of the present invention, uniform liquid distribution can be achieved securely using a simple structure, thus achieving reduction in the fabrication cost and improvement of heat exchange effectiveness.

BEST MODE FOR CARRYING OUT THE INVENTION

Figure 1:
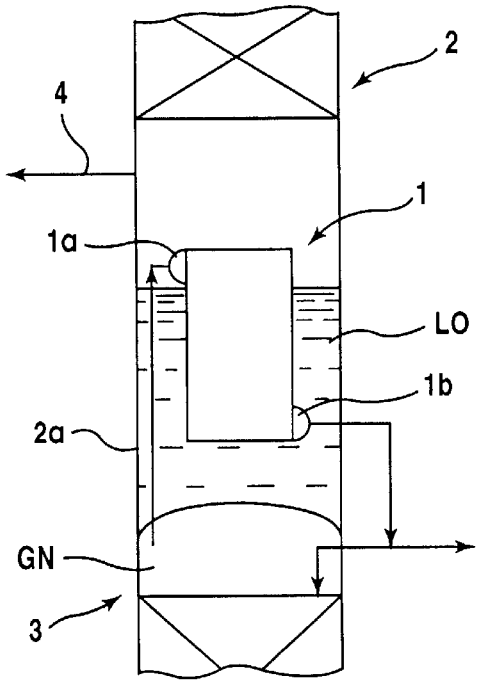
FIG.1 (PRIOR ART)
FIG. 1 is a system diagram showing an example of a conventional submerged reboiler-condenser.
Figure 2:
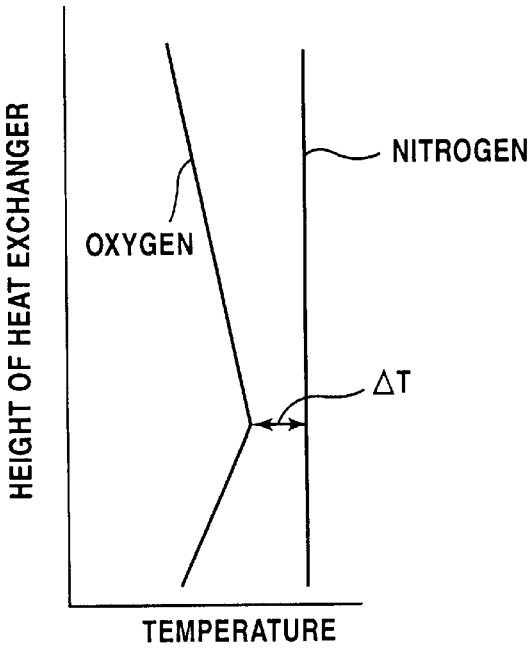
FIG.2 (PRIOR ART)
FIG. 2 is a chart schematically showing temperature distribution in the submerged reboiler-condenser shown in FIG. 1.
Figure 3:
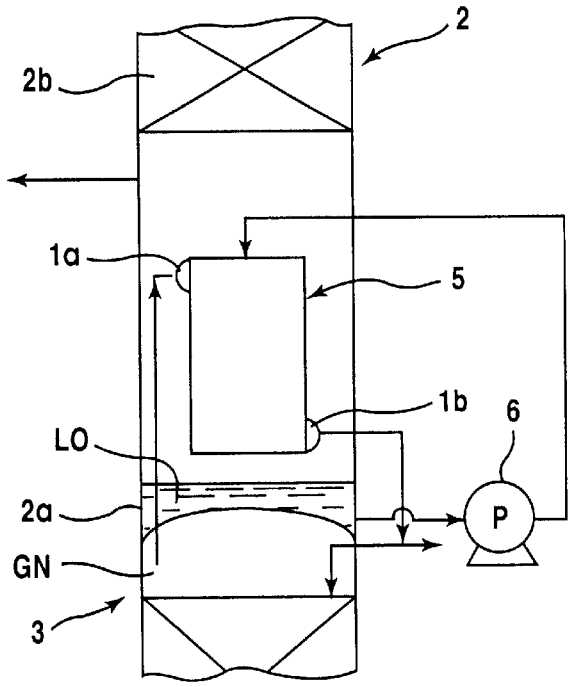
FIG.3 (PRIOR ART)
FIG. 3 is a system drawing showing an example of the conventional downflow reboiler-condenser.
Figure 4:
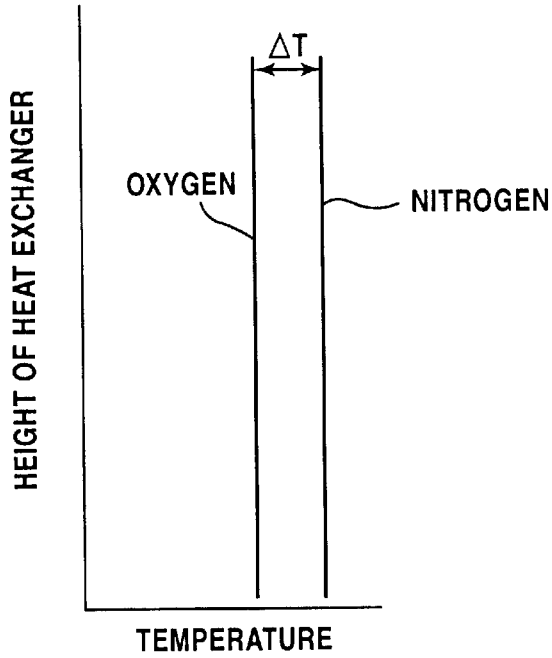
FIG.4 (PRIOR ART)
FIG. 4 is a chart schematically showing temperature distribution in the downflow reboiler-condenser shown in FIG. 3.
Figure 5:
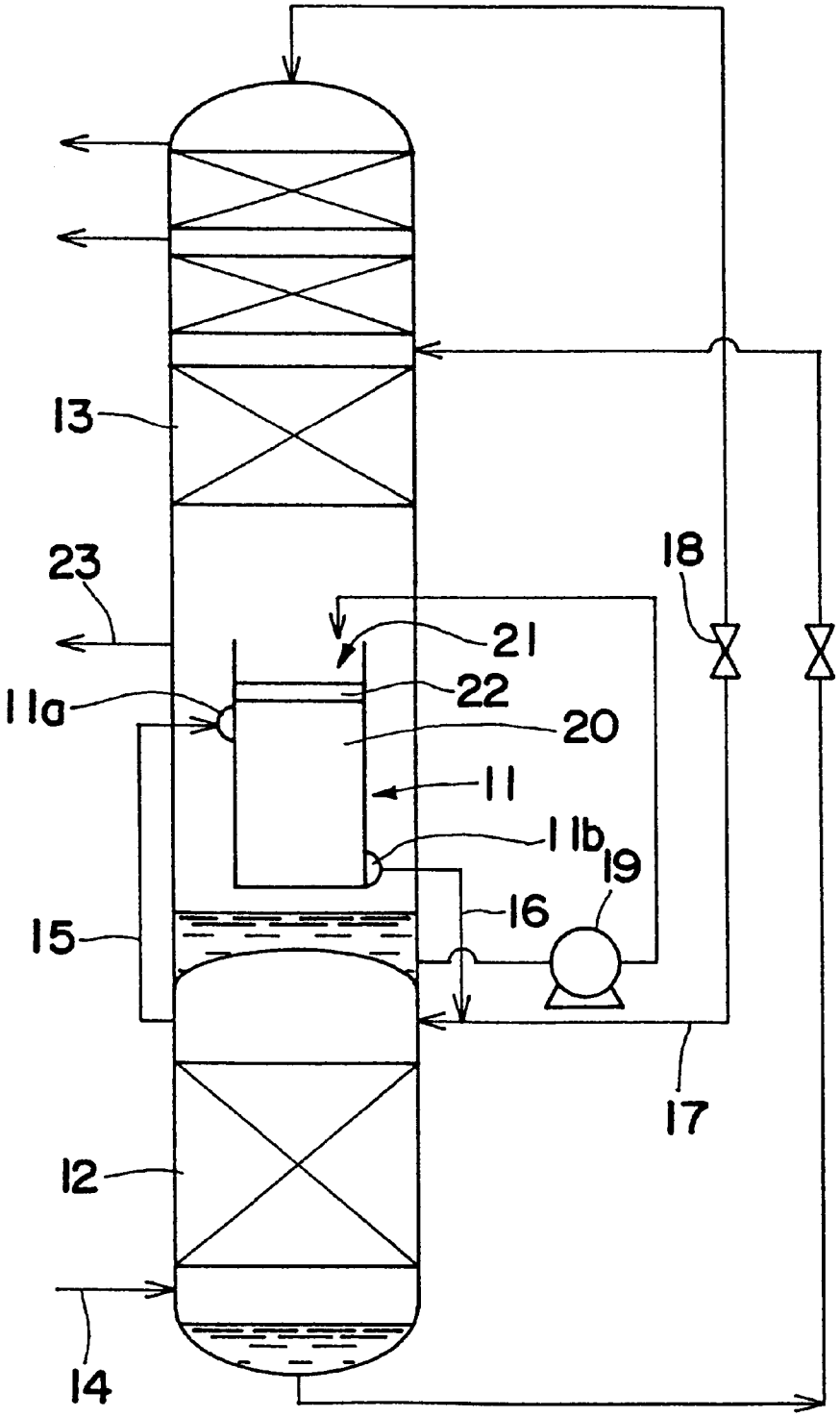
FIG. 5 is a system drawing showing an example in which the downflow reboiler-condenser of the present invention is applied to a double distillation column of an air plant.

FIG. 5 is a system drawing showing an example in which the downflow reboiler-condenser of the present invention is applied to a double distillation column of an air separation plant. The downflow reboiler-condenser (hereinafter referred simply to as reboiler-condenser) 11 is located at a middle part of the double distillation column, i.e., between a high pressure column 12 and a low pressure column 13. Air supplied as a raw gas is compressed and then purified by removing impurity contents including carbon dioxide, moisture, etc., and the thus purified air flows through a main heat exchanger and is introduced through a line 14 to the bottom of the high pressure column 12. The feed air introduced to the high pressure column 12 is separated in the high pressure column 12 by cryogenic distillation procedures well known in the art into an overhead nitrogen gas and a bottom oxygen-enriched liquid air.

The overhead nitrogen gas in the high pressure column 12 is withdrawn into a line 15 and is introduced from an upper header 11*a* of the reboiler-condenser 11 to the tops of condensation passages to be condensed into a liquid by indirect heat exchange with the liquid oxygen concurrently flowing in evaporation passages located adjacent to each condensation passage. The resulting liquid nitrogen is withdrawn from a lower header 11*b* into a line 16, and a part of it is introduced to the top of the high pressure column 12, while the rest of it is introduced through a line 17 and a valve 18 to the top of the low pressure column 13 respectively as a reflux.

Meanwhile, the liquid oxygen flowing down the distillation section of the low pressure column 13 is withdrawn from the bottom of the low pressure column 13 to be collected together with the liquid oxygen fed by a pump 19 to a reservoir 21 located above a heat exchanger core 20 constituting the reboiler-condenser 11 and is then introduced to a liquid distributor 22 located above each evaporation passage. In the liquid distributor 22, the liquid oxygen is distributed uniformly to flow down each evaporation passage of the heat exchanger core 20.

The liquid oxygen flowing down the evaporation passages is partly vaporized by indirect heat exchange with the nitrogen gas flowing concurrently along the condensation passages formed adjacent to each evaporation passage, and the resulting oxygen gas obtained by vaporization is withdrawn from the lower ends of the evaporation passages to assume an ascending gas in the low pressure column 13. A part of the oxygen gas is withdrawn as a product oxygen gas from a lower line 23 of the low pressure column 13. Meanwhile, the liquid oxygen which did not vaporize is withdrawn from the lower ends of the evaporation passages to be collected to the bottom of the low pressure column 13 and is introduced again to the reservoir 21 by the pump 19 for circulation.

Figure 6:
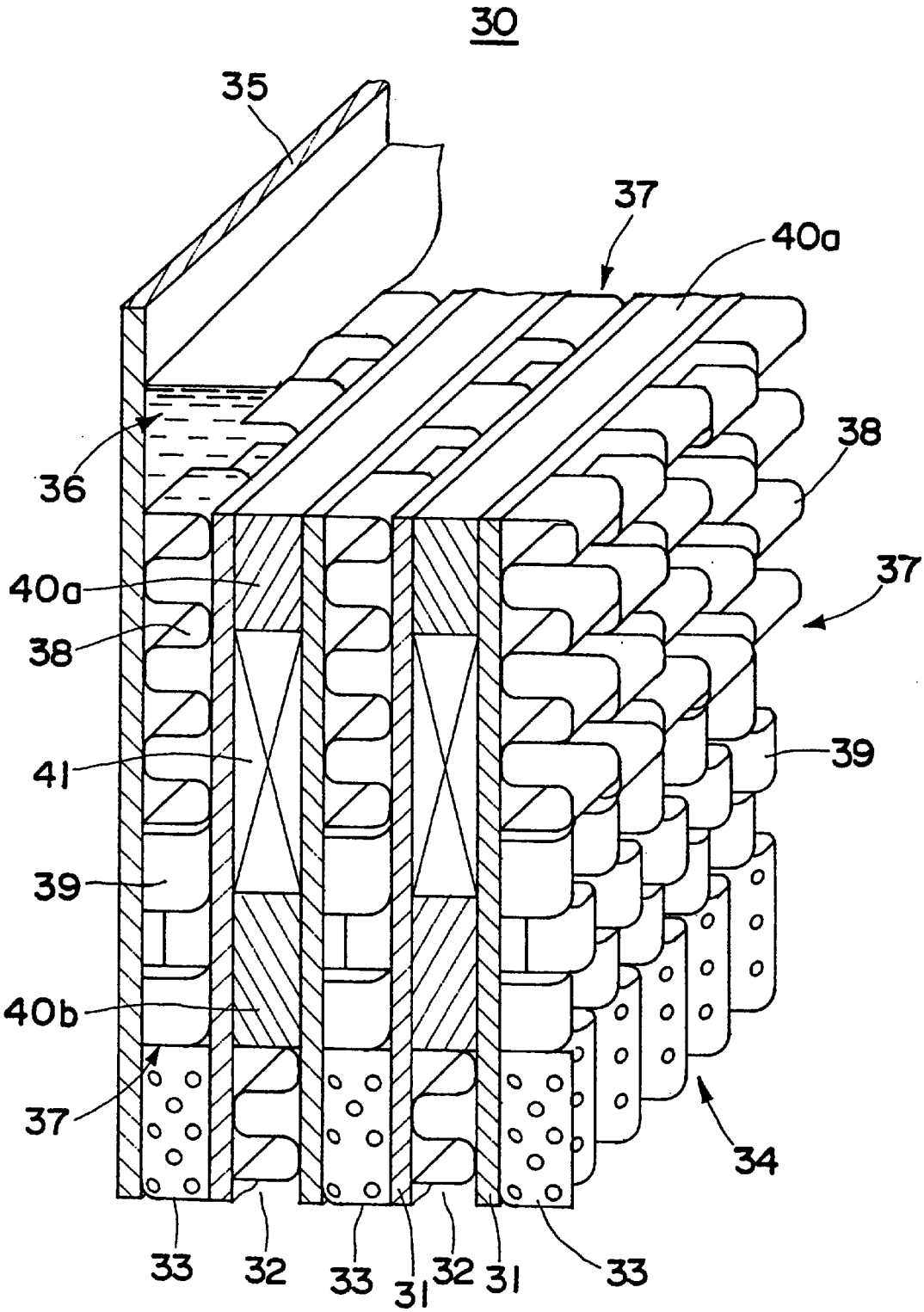
FIG. 6 is a partially cross-sectional perspective view of the relevant portion of the downflow reboiler-condenser according to a first embodiment of the present invention.

FIG. 6 is a partially cross-sectional perspective view of the relevant portion of the downflow reboiler-condenser according to a first embodiment of the present invention. In this reboiler-condenser 30, a reservoir 36 is located at the top of a plate fin type heat exchanger core 34 in which a plurality of condensation passages 32 and a plurality of evaporation passages 33 are formed alternately and successively in spaces defined by a plurality of parallel and vertical parting sheets 31 respectively. The reservoir 36 is surrounded by weir plates 35. A liquid distributor 37 is also located at the top of each evaporation passage 33 so as to distribute the evaporating fluid collected in the reservoir 36 to the evaporation passage 33.

The liquid distributor 37 is composed of an upper liquid distributing section 38 and a lower liquid leading section 39. A hardway finning arranged so as to apply the maximum flow resistance against the main stream constitutes the liquid distributing section 38. The hardway finning is formed using a serrated finning, while the liquid leading section 39 is defined by an easyway finning arranged to provide the minimum flow resistance against the main stream. The easyway finning is formed by using a serrated finning.

Meanwhile, two side bars 40*a* and 40*b* are located above each condensation passage 32 in a vertical relationship at positions where they oppose, via the parting sheets 31, the liquid distributors 37 in the adjacent evaporation passages 33 to define a dummy passage 41 between the side bars 40*a* and 40*b* where no fluid flows.

In the case where the thus formed reboiler-condenser 30 is used as a reboiler-condenser 11 of the air separation plant shown in FIG. 5, the nitrogen gas as the condensing fluid is introduced from an upper lateral side of each condensation passage 32 of a heat transfer section of the heat exchanger and is condensed into a liquid by indirect heat exchange with the liquid oxygen flowing concurrently in the adjacent evaporation passages 33, and the thus formed liquid is withdrawn from lower lateral sides of the condensation passage 32.

Meanwhile, the liquid oxygen introduced a s the evaporating fluid to the reservoir 36 passes through the liquid distributing sections 38 and liquid leading sections 39 of the liquid distributors 37 to flow directly onto the upper end of each evaporation passage 33 and to be vaporized partly by indirect heat exchange with the nitrogen gas flowing concurrently through the adjacent condensation passages 32, while the oxygen gas obtained by the vaporization and the rest of the liquid oxygen which did not vaporize are withdrawn from the bottom of the evaporation passage 33.

As described above, liquid oxygen can be introduced securely and uniformly to the evaporation passages 33 by storing the liquid oxygen to be introduced to the evaporation passages 33 temporarily in the reservoir 36 in a suitable depth and distributing the liquid oxygen uniformly through the liquid distributing sections 38 each composed of a hardway finning having a liquid distribution accelerating function, before it is introduced to each evaporation passage 33 via the liquid leading section 39 composed of an easyway finning having a function of leading the liquid to the evaporation passages 33.

In addition, since the reservoir 36 is defined by the weir plates 35 formed by extending the housing of the heat exchanger core 34 so as to collect liquid oxygen therein to a suitable depth depending on the flow resistance of the liquid distributors, the liquid oxygen can be introduced uniformly into the liquid distributors 37 located above the evaporation passages 33 respectively, achieving distribution of the liquid oxygen more uniformly into each evaporation passage 33.

Further, a dummy passage 41 where no fluid flows is defined above each condensation passage 32 located adjacent to each liquid distributor 37 via the parting sheet 31 so that the liquid oxygen flowing down through the liquid distributing sections 38 and liquid leading sections 39 in the liquid distributors 37 may not be vaporized by the heat of the nitrogen gas flowing through the adjacent condensation passages 32. Thus, there occurs no vaporization of the liquid oxygen in the liquid distributors 37 to be a hindrance of the flow of the liquid, achieving uniform liquid distribution stably. Incidentally, a suitable finning can be disposed in each dummy passage 41 so as to enhance the structural strength.

As a variation (not shown) of the above embodiment, the reservoir 36 may be replaced with a header having a pipe for introducing an evaporating fluid and another header having a pipe for withdrawing the evaporating fluid to be attached to the upper end and to the lower end of the heat exchanger core 34, respectively. In this case, since the evaporating fluid can be introduced and withdrawn to and from the evaporation passages 33 through pipes connected to these two headers respectively, the reboiler-condenser 30 can be installed at a desired position outside the vessel of the low pressure column and the like, facilitating layout of equipments in the plant, in turn, leading to reduction in the fabrication cost.

Figure 7:
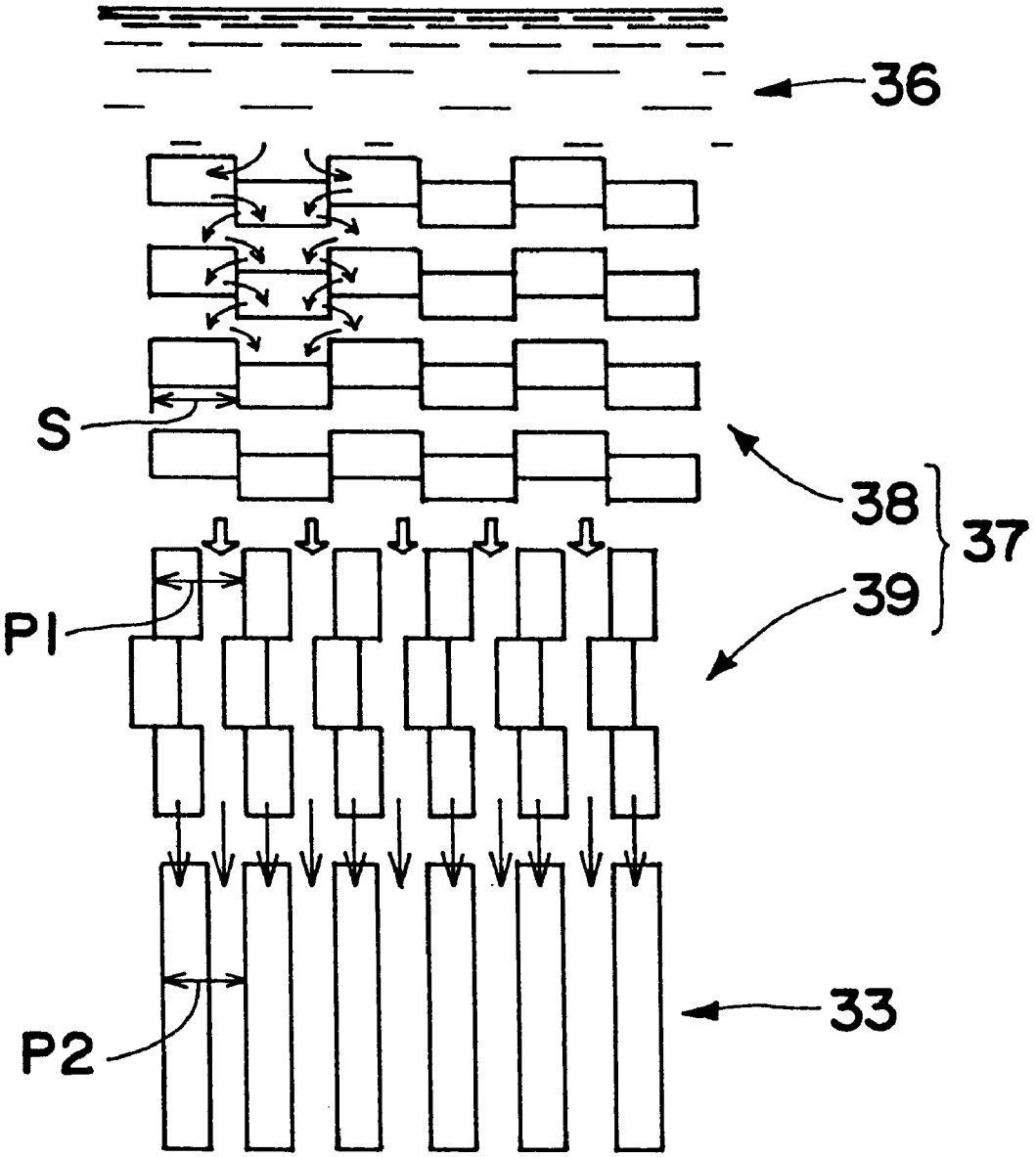
FIG. 7 shows schematically flow of an evaporating fluid assuming the liquid form from the reservoir into the evaporation passages in the downflow reboiler-condenser of the present invention.

FIG. 7 shows schematically the liquid flow of the evaporating fluid from the reservoir 36 to the evaporation passages 33. The evaporating fluid (liquid oxygen) in the reservoir 36 having a liquid head formed by the flow resistance of the hardway finning in the liquid distributing section 38 is distributed uniformly as it flows along the hardway finning in the liquid distributing section 38 forming zigzag flows consisting of repetitions of crosswise flows orthogonal to the perpendicular main flows. Since the hardway finning in the liquid distributing section 38 provides a great flow resistance to form a liquid sealing section, the liquid oxygen can flow down along the hardway finning, but the oxygen gas formed by vaporization in the evaporation passages 33 cannot flow up cutting through the liquid sealing section. That is, since there is no ascending flow of gas to be a hindrance of liquid distribution in the hardway finning, uniform liquid distribution can be achieved.

The liquid oxygen to be led downward after uniform distribution through the liquid distributing section 38 is introduced to the liquid leading section 39 composed of an easyway finning having a liquid leading function to be distributed securely into each evaporation passage 33 of the heat transfer section of the heat exchanger. Here, the serration length S of the hardway finning is preferably not longer than the fin pitch P2 of the finning in the evaporation passage 33, whereas the fin pitch P1 of the easyway finning in the liquid leading section 39 is preferably not longer than the serration length S of the hardway finning in the liquid distributing section 38, more preferably equal to or ½ the pitch P2 of the finning in the evaporation passage 33. Thus, transference of liquid from section to section can be carried out more effectively.

While the embodiment shown above is of a preferred case where the liquid distributors 37 are each composed of a liquid distributing section 38 and a liquid leading section 39, it is also possible to obtain sufficient performance if the liquid distributors 37 are each composed of a liquid distributing section 38 only.

Figure 8:
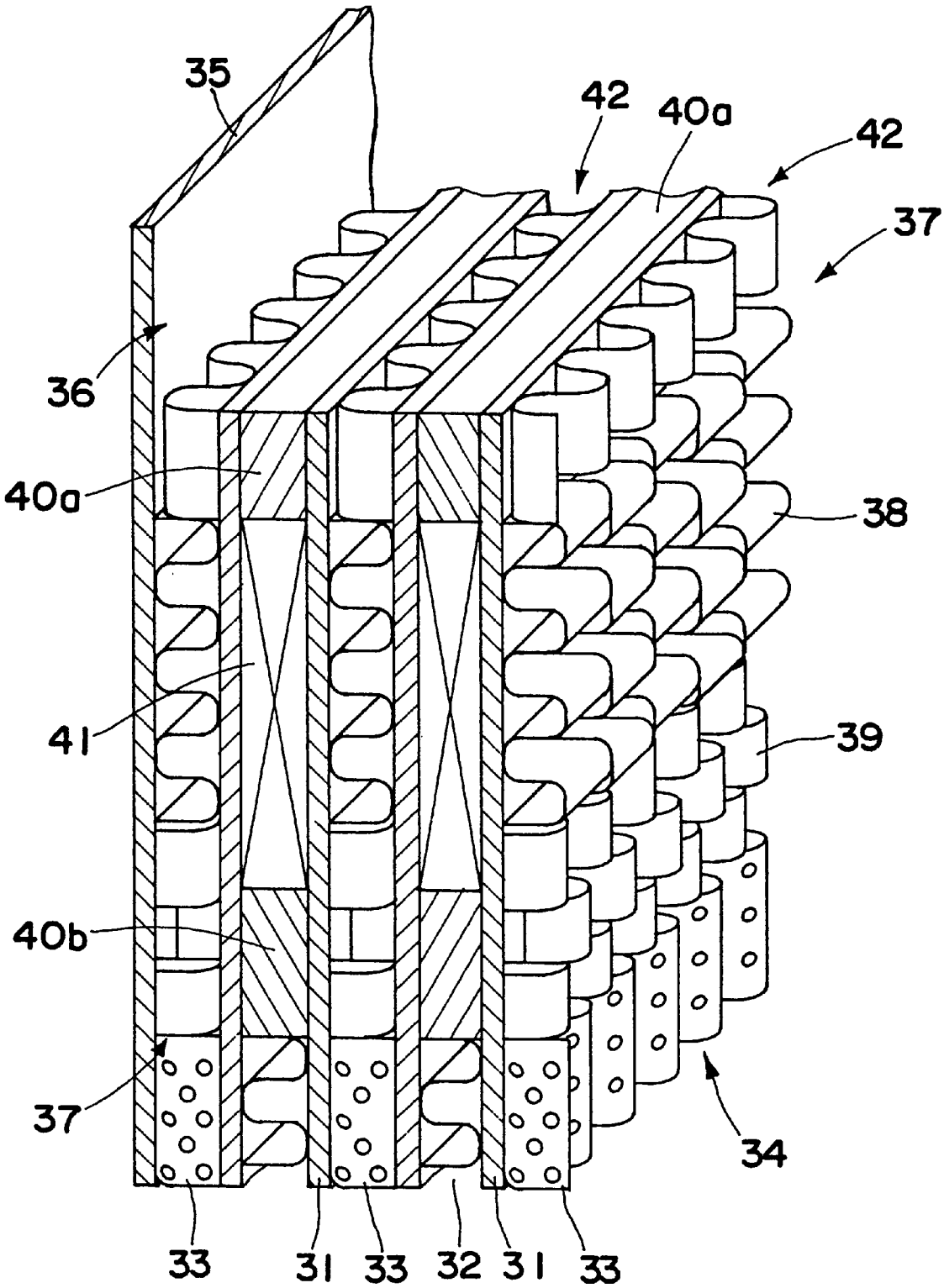
FIG. 8 is a partially cross-sectional perspective view of the relevant portion of the downflow reboiler-condenser according to a second embodiment of the present invention.

FIG. 8 shows the reboiler-condenser according to a second embodiment of the present invention. It should be noted here that the same and like elements as in the first embodiment are affixed with the same reference numbers respectively, and detailed description of them will be omitted. In the reboiler-condenser shown in this embodiment, a liquid inlet section 42 each composed of a perforated finning, a serrated finning or the like is located on the upstream side of or above each liquid distributing section 38 composed also of a hardway finning. The liquid inlet section 42 has a function of leading the liquid oxygen to be introduced from the reservoir 36 to the hardway finning of the liquid distributing section 38. Brazing treatment at the upper end of the heat exchanger core 34 can be ensured by providing, as described above, the liquid inlet sections 42 each composed of a perforated finning, a serrated finning, etc. on the upper end of the heat exchanger core 34, and the heat exchanger core 34 can be fabricated easily and securely.

Figure 9:
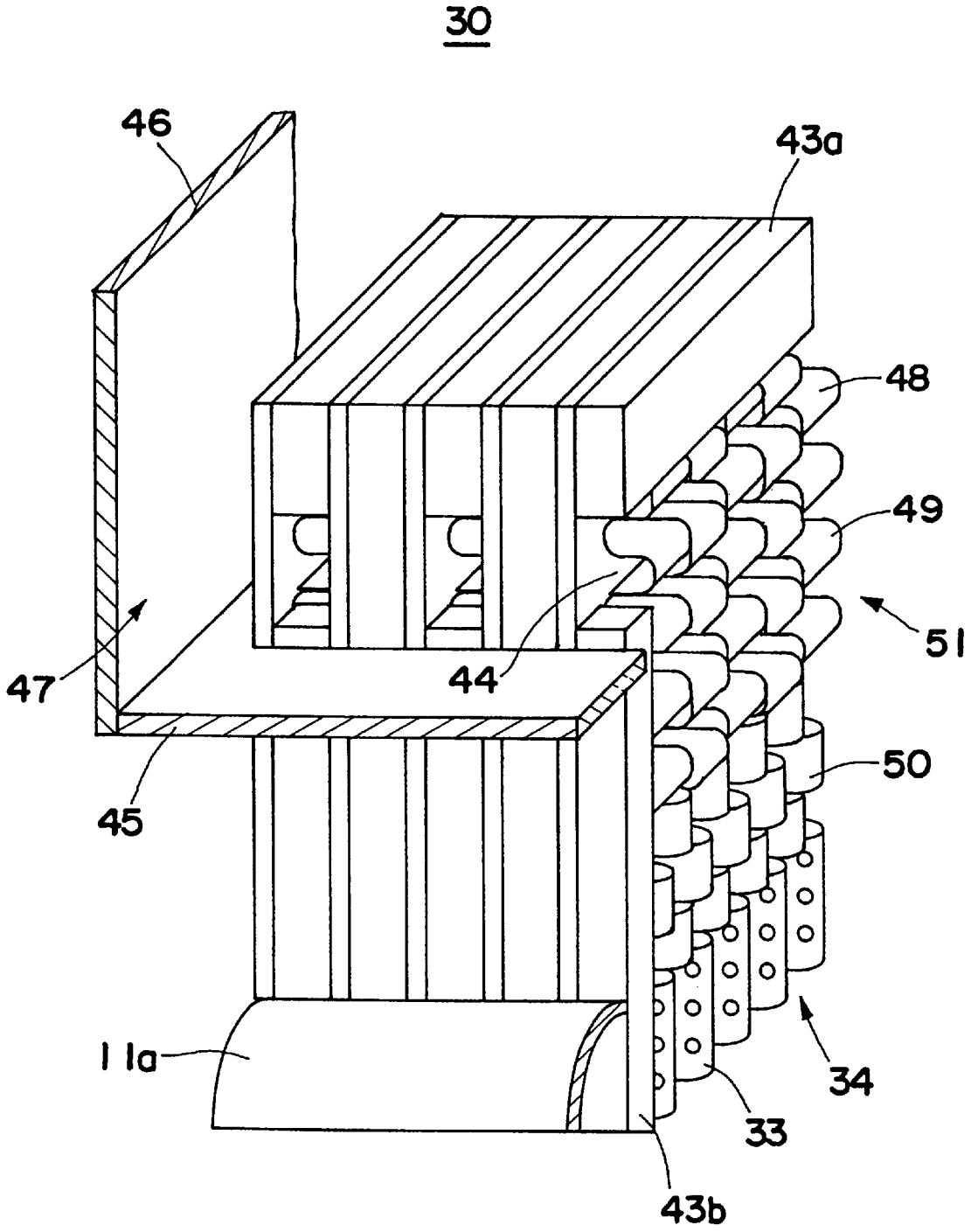
FIG. 9 is a partially cross-sectional perspective view of the relevant portion of the downflow reboiler-condenser according to a third embodiment of the present invention.

FIG. 9 shows the reboiler-condenser according to a third embodiment of the present invention. It should be noted here that the same and like elements as in the first embodiment are affixed with the same reference numbers respectively, and detailed description of them will be omitted. In the reboiler-condenser shown in this embodiment, openings are defined at upper lateral sides of each evaporation passage, with a liquid receiver being located at such position so as to lead an evaporating fluid from the liquid receiver and through these openings into the evaporation passages.

That is, the upper end of each evaporation passage 33 is closed by a horizontal side bar 43*a*, and openings 44 are defined by arranging a vertical side bar 43*b* at each side of each evaporation passage 33 with a suitable clearance with the side bar 43*a*. A liquid receiver 47 composed of a bottom plate 45 surrounding the heat exchanger core 34 and an enclosure 46 formed to surround the bottom plate 45 is located around the openings 44, and further a liquid distributor 51 consisting of an upper liquid inlet section 48 composed of a hardway finning, an intermediate liquid distributing section 49 composed of a hardway finning and a lower liquid leading section 50 composed of an easy finning is located above each evaporation passage 33. Further, the lower end (bottom) of each evaporation passage 33 is opened like in the above embodiment.

This constitution can also exhibit similar effects to those in the above embodiment. Incidentally, the openings 44 may be formed on one side or on each side of the evaporation passages 33. Meanwhile, the upper liquid inlet section 48 can be located such that the upper end thereof is aligned with the upper or lower end(s) of the upper lateral opening(s) 44. Further, one kind of hardway finning may integrally constitute the upper liquid inlet section 48 and the intermediate liquid distributing section 49.

Further, as a variation of this embodiment, the liquid receiver 47 may be replaced with a header having a pipe for introducing an evaporating fluid and another header having a pipe for withdrawing the evaporating fluid to be attached to the upper lateral openings and to the lower end openings of the heat exchanger core 34, respectively, like in the variation of the first embodiment. Further, the lower end portion of each evaporation passage 33 can be designed to have the same configuration as that of the upper end portion. That is, the lower end openings of the evaporation passages 33 may be closed with horizontal side bars to define lower lateral openings to which a header can likewise be attached. In this case, like in the variation of the first embodiment, the condensation passages (32 in FIG. 6) present lower than the withdrawing header (11*b* in FIG. 5) can be defined as dummy passages where no fluid flows.

As described above, in the downflow reboiler-condenser, a liquid distributor using a finning which is a component part of a general plate fin type heat exchanger and having a function of distributing a liquid uniformly resorting to the flow resistance of the finning is attached to the top of each evaporation passage in the heat exchanger core, thus achieving uniform liquid distribution using only the evaporation passages without using the condensation passages located adjacent to each evaporation passage and achieving introduction of the evaporating fluid uniformly and securely into the evaporation passages. Accordingly, not only heat transfer performance of the heat exchanger can be improved but also the structure of the heat exchanger is simplified, leading to reduction in the fabrication cost thereof. Further, the headers, having pipes for introducing and withdrawing the evaporating fluid respectively, attached to the openings of the evaporation passages make layout of equipment easy, since the reboiler-condenser can be installed outside the vessel.

It should be noted here that the downflow reboiler-condensers in the above embodiments were described referring to the case where they are each used as a reboiler-condenser to be installed to the middle part of a double distillation column in an air separation plant. However, the present invention is not to be limited to such cases, but they can be utilized as reboiler-condensers to be installed to the top of a single distillation column and as many other kinds of reboiler-condensers used for carrying out indirect heat exchange between a condensing fluid and an evaporating fluid.

What is claimed is:

1. A downflow reboiler-condenser comprising a plate fin type heat exchanger core containing a plurality of condensation passages and a plurality of evaporation passages formed alternately and successively in spaces defined by a plurality of parallel and vertical parting sheets, respectively, the reboiler-condenser carrying out indirect heat exchange via the parting sheets between a gaseous fluid to be condensed (condensing fluid) introduced from an upper lateral side of the condensation passages and a fluid to be evaporated (evaporating fluid) flowing down onto each evaporation passage to effect condensation of the condensing fluid into a liquid and also vaporization of the evaporating fluid into a gas;

wherein the evaporation passages are each formed to have an upper end opening and a lower end opening; a reservoir communicating to the upper end opening of each evaporation passage is located above the heat exchanger core; liquid distributing means is located above each evaporation passage to distribute the evaporating fluid collected in the reservoir into the evaporation passage; and wherein the liquid distributing means is composed essentially of an easyway finning serving as an upper liquid inlet section, a hardway finning serving as an intermediate liquid distributing section and an easyway finning serving as a lower liquid leading section.

2. The downflow reboiler-condenser according to claim 1, wherein the hardway fining is of a serrated finning.

3. The downflow reboiler-condenser according to claim 1 or 2, wherein the easyway finning in the liquid leading section has a fin pitch not longer than the length of the serration of the hardway finning in the liquid distributing section.

4. The downflow reboiler-condenser according to claim 1, wherein the reservoir comprises a header having a pipe for introducing the evaporating fluid and another header is provided having a pipe for withdrawing the evaporating fluid, respectively.

5. The downflow reboiler-condenser according to claim 4, wherein the hardway finning is of a serrated finning.

6. The downflow reboiler-condenser according to claim 4 or 5, wherein the easyway finning in the liquid leading section has a fin pitch not longer than the length of the serration of the hardway finning in the liquid distributing section.

* * * * *